United States Patent [19]

Babin

[11] 4,207,147

[45] Jun. 10, 1980

[54] ELECTRODE FOR THE ELECTROLYTIC DEPOSITION OF METALS

[75] Inventor: Lucien Babin, Valleyfield, Canada

[73] Assignee: Noranda Mines Limited, Toronto, Canada

[21] Appl. No.: 950,447

[22] Filed: Oct. 11, 1978

[30] Foreign Application Priority Data

Oct. 11, 1977 [CA] Canada ..... 288444

[51] Int. Cl.[2] ..... C25C 7/02; C25D 1/10

[52] U.S. Cl. ..... 204/12; 204/281

[58] Field of Search ..... 204/12, 281

[56] References Cited

U.S. PATENT DOCUMENTS

| | | | |
|---|---|---|---|
| 1,470,883 | 10/1923 | Schuh | 204/281 |
| 1,994,144 | 3/1935 | Merrill | 204/6 |
| 2,509,722 | 5/1950 | Carl | 204/281 |
| 2,536,877 | 1/1951 | Emanuel et al. | 204/281 |
| 3,530,047 | 9/1970 | Billett | 204/12 |
| 3,804,724 | 4/1974 | Bolger et al. | 204/12 |

FOREIGN PATENT DOCUMENTS

| | | | |
|---|---|---|---|
| 882292 | 9/1971 | Canada | 204/281 |
| 382742 | 8/1973 | U.S.S.R. | 204/281 |

*Primary Examiner*—T. M. Tufariello
*Attorney, Agent, or Firm*—Fleit & Jacobson

[57] ABSTRACT

An electrode for the electrolytic deposition of metals is disclosed. The electrode comprises a metal plate adapted to be suspended vertically in an electrolyte solution and having round corners joining the side edges to the bottom edge thereof, and a continuous edge strip of electrically insulating material enveloping the side and bottom edges of the plate to prevent deposition of metal on the edges during electrolysis.

5 Claims, 3 Drawing Figures

ELECTRODE FOR THE ELECTROLYTIC DEPOSITION OF METALS

This invention relates to electrodes used for the electrolytic deposition of metal which is subsequently stripped therefrom, and more particularly to electrode plates having edge strips of electrically insulating material for preventing deposition of metal on the edges of the plate.

In the electrolytic recovery of non-ferrous metals using cathode plates suspended vertically in an electrolyte bath, it is well known to secure strips of electrically insulating material along the side and bottom edges of the plates to prevent deposition of metal around the edges so as to facilitate stripping of the deposited metal from the plates. The edge strips are made in three pieces, one on each side and one at the bottom, and are welded at the corners to insure adequate electrical insulation. As it will be easily understood, it is important to insure perfect electrical insulation at the corners since even a slight imperfection in the weld, a crack or a pinhole, will cause deposition of metal at the location of the exposed metal. Such local depositions of metal often result in the formation of "mushrooms" which are large enough to cause short circuits between the electrodes. In addition, such mushrooms often break loose during handling of the cathodes or during stripping of the deposited metal and cause breakdown of the handling or stripping equipment resulting in a loss of time and money.

In order to overcome this welding problem, it has been proposed to install preformed frames around the side and bottom edges of the plates. However, the manufacture, handling and storage of these preformed frames are time consuming and costly.

It is therefore the object of the present invention to provide an electrode structure having an edge strip which is not subject to the above drawbacks.

The electrode for the electrolytic deposition of metals, in accordance with the invention, comprises a metal plate adapted to be suspended vertically in an electrolytic solution and having round corners joining the side edges to the bottom edge thereof, and a continuous edge strip of electrically insulating material enveloping the side and bottom edges of the plate to prevent deposition of metal on the edges during electrolysis. p The electrode plate preferably has a plurality of holes formed along the side and bottom edges and along the round corners and the material of the continuous edge strip is pressed into such holes for securing the strip to the edges of the plate.

The strip is provided with a longitudinal groove having a width about equal to the thickness of the metal plate so as to envelope the edge of the plate. The strip is preferably made of polyethylene although other suitable materials are envisaged.

The invention will now be disclosed, by way of example, with reference to the accompanying drawings in which.

Figure 1:
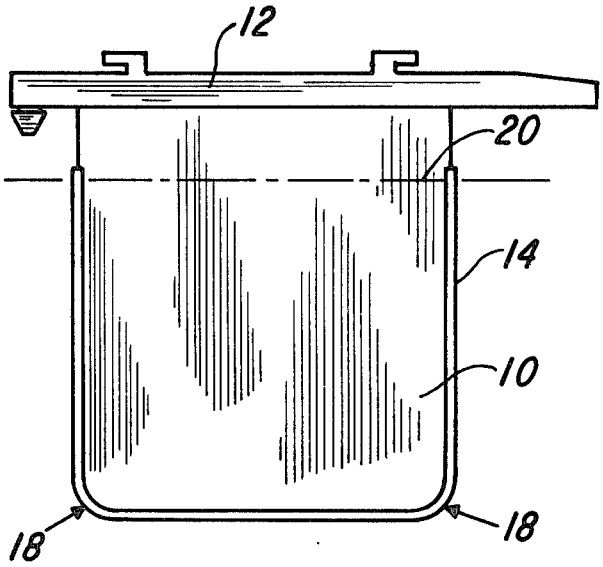
FIG. 1 illustrates a side view of an electrode in accordance with the invention.
Figure 2:
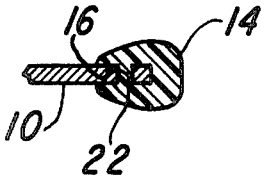
FIG. 2 illustrates a sectional view through line 2—2 of FIG. 3.

Referring to FIG. 1, there is shown an electrode plate 10 attached to a bar 12 which supports the plate when it is immersed vertically in an electrolyte bath. A continuous edge strip of polyethylene material 14 is secured along the side and bottom edges of the plate. As illustrated in FIG. 2, the strip has a groove 16 which is about the same width as the thickness of the plate so as to envelop both sides of the plate at the edges. The bottom corners 18 of the plate are rounded so as to permit the strip to be easily bent around the corners. The radius of the corners should be as small as possible so as not to increase the current density of a plate of predetermined dimensions. Of course, this minimum radius is limited by the flexibility of the strip. A radius of one inch has been found adequate using polyethylene strips. The upper ends of the strip extends a little above the level 20 to which the plate is normally immersed in the electrolyte.

The strip 14 is normally made of polyethylene although other electrically insulating material such as polyvinylchloride (PVC), polypropylene, neoprene or rubber could be used provided they are sufficiently flexible to be applied onto the edges and strong enough to withstand the conditions of the electrolytic process and the successive stripping of the deposited metal.

Figure 3:
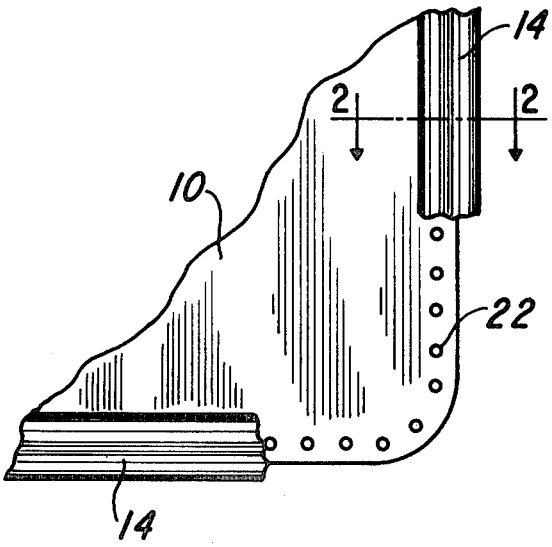
FIG. 3 illustrates an enlarged view of a portion of FIG. 1.

In order to more adequately secure the strip 14 to the edge of the plate 10, a plurality of holes 22 are provided along the side and bottom edges of the plate as well as around the corners 18, as shown in FIG. 3.

Before assembly, the side and bottom edges as well as the corners of the plate are cleaned. The continuous strip 14 is subsequently mounted in a single piece on the side and bottom edges of the plate 10 around the profiled corners 18. The assembly is then heated simultaneously on both sides to a given temperature by means of electrical heating elements or otherwise until the insulating material is in a given soft state. Pressure is then applied to the strip by any suitable means so as to permit the soft insulating material to stick to the edges of the plate. The soft insulating material also flows into the holes 22, as shown in FIG. 2, to provide additional anchoring of the strip to the edges of the plate. The heating and pressing operations may be done on a single or on separate machines.

The strip could also be glued to the edges of the plate instead of being heat pressed provided that the material of the strip is flexible enough to follow the contour of the plate at the corners without heat being applied.

The advantages of the present invention over the prior art are as follows:

(a) The use of a continuous strip with no weld at the corners ensures perfect electrical insulation at the time of installation and also reduces the risks of cracks or pinholes being developed later on during operation.

(b) The installation is simple and rapid.

(c) Preformed frames would certainly be more costly to manufacture as they would have to be custom made to the right size and shape. These would also be awkward to handle and store. In the present invention, simple extruded strips of predetermined length are needed.

The above electrode is normally used for the recovery of zinc. It could also be used for the production of copper starting sheets made for electrorefining of copper or other metals.

What is claimed is

1. An electrode for the electrolytic deposition of metals comprising:

(a) a metal plate adapted to be suspended vertically in an electrolytic solution and having round corners joining the side edges to the bottom edge thereof and a plurality of holes formed along the side and bottom edges and along the round corners; and (b) a continuous edge strip of electrically insulating material having a longitudinal groove therein of a width about equal to the thickness of the metal plate so as to closely envelop the side and bottom edges of the plate, and wherein the material of the continuous edge strip is heat-pressed into said holes for anchoring the strip to the plate.

2. An electrode for the electrolytic deposition of metals comprising:

(a) a metal plate adapted to be suspended vertically in an electrolytic solution and having round corners joining the side edges to the bottom edge thereof and a plurality of holes formed along the side and bottom edges and along the round corners;

(b) a continuous, unitary edge strip of electrically insulating material having a longitudinal groove therein of a width substantially equal to the thickness of said metal plate, said strip matingly engaging said metal plate so as to closely envelop the side and bottom edges of said metal plate and to cover said plurality of holes; and (c) means for securing said strip to said metal plate by the steps of heating the strip when said strip is matingly engaged with said metal plate until the insulating material of said strip is in a soft state, and then pressing the soft insulating material to cause some of the material to flow into said holes to anchor the strip to the edges of said metal plate.

3. An electrode plate as defined in claim 1, or claim 2, wherein the edge strip is made of polyethylene.

4. An electrode as defined in claim 1 or claim 2, wherein the metal plate is made of aluminum and used for the electrolytic recovery of zinc from a zinc bearing solution.

5. A method for manufacturing an electrode used in the electrolytic deposition of metals, the method comprising the steps of:

(a) providing a generally rectangular metal plate having round corners joining the side edges to the bottom edge thereof;

(b) providing a plurality of holes along the side and bottom edges and around the round corners of the metal plate;

(c) enveloping the side and bottom edges as well as the round corners of the plate with a continuous, unitary edge strip of electrically insulating material;

(d) heating the strip of electrically insulating material after assembly around the edges of the plate until the insulating material is in a soft state; and (e) pressing the soft electrically insulating material to cause some of the material to flow into the holes to anchor the strip to the edges of the plate.

* * * * *